US009572386B1

(12) United States Patent
Scheer et al.

(10) Patent No.: US 9,572,386 B1
(45) Date of Patent: Feb. 21, 2017

(54) MAGNETIC CLOSURE FOR CLOTHING WITH NON-MAGNETIC BACKING

(75) Inventors: Lawrence Scheer, New York, NY (US); Lauren Feuer, New York, NY (US)

(73) Assignee: Magnificent Baby L.L.C., New York, NY (US)

( * ) Notice: Subject to any disclaimer, the term of this patent is extended or adjusted under 35 U.S.C. 154(b) by 326 days.

(21) Appl. No.: 12/906,056

(22) Filed: Oct. 15, 2010

(51) Int. Cl.
*A41F 1/00* (2006.01)
*A41D 11/00* (2006.01)

(52) U.S. Cl.
CPC ..... *A41F 1/002* (2013.01); *A41D 11/00* (2013.01); *A41D 2300/30* (2013.01); *A44D 2203/00* (2013.01); *Y10T 24/32* (2015.01)

(58) Field of Classification Search
CPC ..... A41F 1/002; A41F 1/00; A44D 2203/00; A44B 17/00; A45C 13/10; A45C 13/1069; A41D 11/00; A41D 2300/003; Y10T 24/32
USPC ..... 24/303, 66.1; 335/285, 302–306; 292/251.5
See application file for complete search history.

(56) References Cited

U.S. PATENT DOCUMENTS

| | | | | |
|---|---|---|---|---|
| 2,319,292 | A | 5/1943 | Boggs | |
| 2,389,298 | A | 11/1945 | Ellis | |
| 2,397,931 | A | 4/1946 | Ellis | |
| 3,008,209 | A | 11/1961 | Kurt | |
| 3,161,932 | A | 12/1964 | Russell | |
| 5,604,960 | A | 2/1997 | Good | |
| 6,378,174 | B1 * | 4/2002 | Wong | 24/303 |
| 6,434,801 | B2 | 8/2002 | Grunberger | |
| 6,972,654 | B1 * | 12/2005 | Brock | 335/285 |
| 7,065,841 | B2 | 6/2006 | Sjoquist | |
| 2002/0178551 | A1 * | 12/2002 | Hsu | A41F 1/002 24/303 |
| 2008/0104742 | A1 * | 5/2008 | Alperin et al. | 2/321 |

FOREIGN PATENT DOCUMENTS

JP 2005028022 A * 2/2005 ..... A44B 1/02

OTHER PUBLICATIONS

Koga et al., Machine Translation—JP 2005-28022 A, pp. 1-5.*
Formal Translation—JP 200528022A, Koga et al., Mar. 2, 2005, pp. 1-14.*

* cited by examiner

*Primary Examiner* — Abigail Morrell
(74) *Attorney, Agent, or Firm* — Wolf, Greenfield & Sacks, P.C.

(57) ABSTRACT

One embodiment of a flat, round magnet (1) inserted into a non-magnetic metal "cup" (2) and enclosed entirely within a square, thin laminate covering (3). The flat, round magnet (1) is inserted such that one flat surface of the magnet is exposed and the opposite flat surface of the magnet is set against the inner surface of the non-magnetic metal cup (2). The non-magnetic metal cup (2) serves to block or reduce the magnetic force of the surface of the flat, round magnet (1) set against the inner surface of the cup. Such magnet, cup and laminate assemblies with exposed magnet surfaces of opposing polarities can be sewn or stitched on opposing sides of garment or clothing openings and used close or fasten the garment or clothing utilizing magnetic force. Other embodiments are described.

9 Claims, 1 Drawing Sheet

MAGNETIC CLOSURE FOR CLOTHING WITH NON-MAGNETIC BACKING

BACKGROUND—FIELD

This application relates to magnetic fasteners, specifically to such fasteners which are used to close apparel or clothing.

BACKGROUND—PRIOR ART

Apparel and clothing commonly use buttons, snaps, zippers or VELCRO®, a trademark of Velcro Industries B.V., to close or hold shut the garments. In many cases, such common closures may not be suitable for users of apparel and clothing who suffer from reduced manual dexterity due to age, disease, disability or other infirmity. Moreover, buttons, snaps, zippers, hooks and eyes or VELCRO® may not be practical in many circumstances where the use of a user's hands may be limited, such as when attempting to change the clothes of wriggling infant or assisting someone dressing or undressing. VELCRO® may present additional disadvantages as a fastener for apparel as it may catch on hair, pick up lint or cause damage to delicate fabrics in a wash or laundry cycle.

A number of closures using magnetic force close or hold shut garments were designed to purportedly address some of the above mentioned issues. However, it is still uncommon for apparel or clothing to use closures or fasteners utilizing magnetic force, or their use is at least less common than the use of buttons, snaps, zippers, hooks and eyes or VELCRO®. The lack of use of such designs is likely explained by the complicated and impractical design of much of the prior art pertaining to magnetic closures and fasteners for apparel and clothing.

Some of the impracticalities of these designs include complicated strips of magnets, interlocking or nesting mechanisms, adhesives, glue, fusing material, pockets or other methods used to hold the magnetic fasteners in place. The fastener described herein provides the advantages of the use of magnetic fasteners over common closures, such as buttons, snaps, zippers, hooks and eyes and VELCRO®, while utilizing a simplified, practical and improved design for magnetic fasteners for apparel or clothing.

For example, U.S. Pat. No. 3,161,932 to Russell utilizes complimentary strips of magnets arranged such that opposing strips are arranged with opposite magnetic polarity to create attraction. The strip is of purportedly flexible material and the magnets on opposing strips are required to be either held in place with "water resistant" adhesive or put into small "pockets" and must interlock and "nest" in order to fasten. However, adhesive may not necessarily survive the water and temperature of washing and drying and the design does not utilize any means to protect the magnets in the strips from the corrosive effects of water or other liquids. The use of strips is also purportedly intended to reduce "bunching" of the magnets, but with no limitation on the extrusion of magnetic force from both sides of the magnet, it may not prevent apparel or clothing from bunching or sticking to one another. Moreover, the need to use strips of magnets, as opposed to individual magnetic fasteners, may limit the number of applications to which the magnetic fasteners that must utilize strips may be applied.

U.S. Pat. No. 6,434,801 to Grunberger also utilizes a strip of magnets to effect closure, though in the case of this design the magnets of the strip are "hermetically sealed" to reduce corrosion by means of being placed in a "seat" that is created by two "plate-like" elements made of "calendared plastic materials." The coupling of the two "plate-like" elements is achieved by "heat-sealing, ultrasound welding, gluing or the like" and apparently also must be sealed to the clothing to which it is intended to be applied. The patent recommends against sewing as a means to attach the assembly to clothing as it can cause the plastic to break. If one must sew, the patent suggests using fabric coated with PVC or polyurethane for waterproofing, though it is not recommended. Naturally, the reduced practicality of attaching the fastener by sewing limits its utility for use in clothing. The assembly also includes a metal plate with a "metal pin" designed to concentrate "magnetic flux," which could be too bulky or cumbersome for use in delicate fabrics or for clothing for children or infants.

Similarly, U.S. Pat. No. 5,604,960 to Good similarly relies on a strip of magnets with an adhesive, cover layer and fabric support layer to keep the magnets in place. The preferred embodiment uses the adhesive layer rather than stitching to keep the magnets in place.

Several other designs utilize interlocking magnet methods that also may be too difficult for persons with limited manual dexterity or too bulky or cumbersome for use in delicate fabrics or for clothing for children or infants. U.S. Pat. No. 2,389,298 to Ellis uses a complicated series of "corrugated" and "serrated" series of magnets that must interlock using the protruding "pole" pieces of the magnets or through use of a magnetic button. U.S. Pat. No. 3,008,209 to Kurt used "hook shaped" interlocking magnetic fasteners for a zippering affect. U.S. Pat. No. 3,102,314 to Alderfer utilizes strips or "bands" of numerous block-shaped magnets.

Other complicated designs have also been utilized for the use of magnetic fasteners. For example, U.S. Pat. No. 7,065,841 to Sjoquist utilizes a mutli-element fastener requiring a "handle," possibly in the shape of a button, as well as a defined "planar wall" and "peripheral wall" to create a "cavity" in which to insert the magnetic contraption. It also requires holes in the magnet to pass through thread for stitching. U.S. Pat. No. 2,397,931 to Ellis utilizes a magnetic "button" placed in a soft metal "cup" with holes through it so that it may be stitched to a garment, but does not include other useful elements like laminate and in certain embodiments utilizes adhesives, such as glue, to keep the buttons in place.

U.S. Pat. No. 2,319,292 to Boggs is relatively simple in that it relies on a magnetic block stitched into "pockets" on a garment, but again lacks protection from corrosive elements.

As such, magnetic fasteners heretofore developed for use with apparel or clothing suffer from a number of disadvantages:

(a) the use strips of magnets, as opposed to individual magnetic fasteners, may limit the number of applications to which the strips of magnetic fasteners may be applied, such a where only one magnetic fastener may be necessary;

(b) they may rely on adhesives or other fusing material that may not necessarily survive the water and temperature of washing and drying;

(c) they may not utilize any means to protect the magnets in the fasteners from the corrosive effects of water or other liquids;

(d) they may require the interlocking or nesting of magnets in the fastener, thereby limiting any benefits that the use of magnets may have for persons with reduced manual dexterity or in situations limiting the full use of their hands;

(e) they do not include a means to prevent magnets from bunching together or sticking to one another or other items of clothing in proximity by blocking the magnetic force extruded from one pole of the magnet;

(f) they may utilize means of holding the magnetic fasteners in place that may limit their ability to be stitched or sewn into clothing limiting their application to apparel or clothing;

(g) they may utilize designs that are too complicated, such as interlocking hooked magnets, to benefit persons with reduced manual dexterity or in situations limiting the full use of their hands;

(h) they may utilize designs that are too bulky or complicated to be used with delicate fabrics or in infant or childrens' clothing

SUMMARY

In accordance with one embodiment a magnetic fastener comprises a round, flat magnet inserted into a non-magnetic metal cup, such that one flat surface of the magnet is exposed and the reverse flat surface of the magnet is covered by the non-magnetic metal cup, enclosed entirely within a thin, laminate covering.

DRAWINGS—FIGURES

FIG. 1 is a perspective view of a flat, round magnet 1 as it is inserted into a non-magnetic metal cup 2.

FIG. 2 is a top view of one half of a magnetic fastener constructed in accordance with the invention consisting of a flat, round magnet 1 inserted inside a non-magnetic metal cup 2 both of which are enclosed entirely within a square, thin laminate covering 3.

Figure 2:
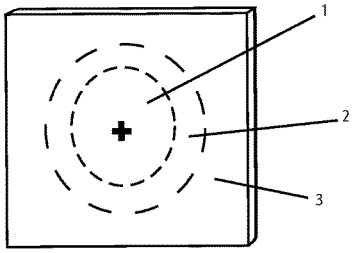
Figure 3:
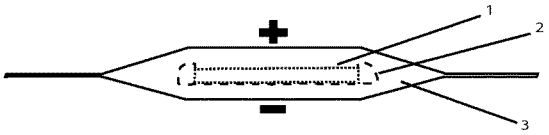
FIG. 3 is a side view of the assembly of FIG. 2.
Figure 5:
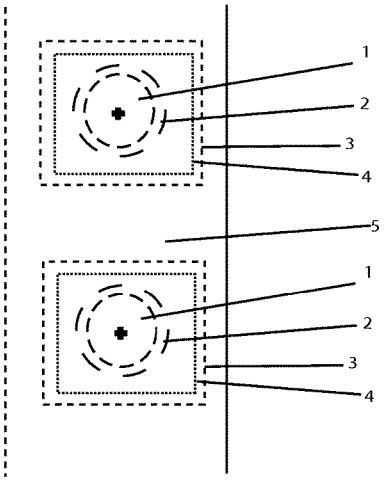

FIG. 5 is a top view of two complete magnet assemblies of FIGS. 2 and 3 sewn into the fabric of a garment 5 by means of stitching 4 with thread or other similar means.

Figure 6:
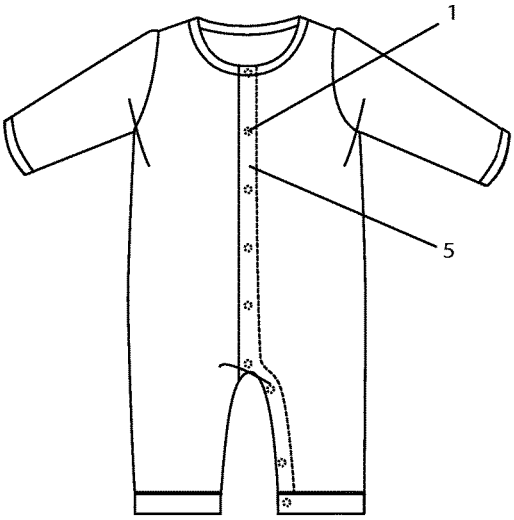

FIG. 6 is a perspective view of complete magnet assemblies of FIGS. 2 and 3 sewn into the fabric of a garment 5.

DETAILED DESCRIPTION—FIRST EMBODIMENT—FIGS. 1-6

Figure 1:
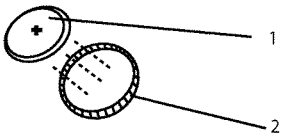

FIG. 1 is a perspective view of a flat, round magnet 1 as it is inserted into a non-magnetic metal "cup" 2. The flat, round magnet 1 is inserted such that one flat surface of the magnet is exposed and the opposite flat surface of the magnet is set against the inner surface of the non-magnetic metal cup 2. The non-magnetic metal cup 2 serves to block or reduce the magnetic force of the surface of the flat, round magnet 1 set against the inner surface of the cup. In a preferred embodiment, the metal cup would be of the same depth or thickness of the magnet, so the edges or rim of the metal cup do not extend beyond the exposed surface of the magnet. As such, the exposed surface of the magnet and the rim of the metal cup are flush and two assemblies facing one another will fit together flush. In a preferred embodiment, the metal cup would consist of iron, which has the property of blocking magnet force, but could consist of other materials. FIG. 1 shows that the pole of the flat, round magnet 1 that is exposed is the positive or "+" pole of the magnet. The magnets may be made by methods now in existence that form no part of this invention. Moreover, in additional embodiments the magnets and metal "cups" could be various shapes, such as square or rectangular, and various sizes as appropriate for the garment.

FIG. 2 is a top view of an assembly of a flat, round magnet 1 inserted inside a non-magnetic metal cup 2 both of which are enclosed entirely within a square, thin laminate covering 3. FIG. 1 shows that the pole of the flat, round magnet 1 that is exposed is the positive or pole. The laminate covering protects both the magnet and the metal cup from exposure to water or other corrosive elements. Further, laminate covering assists in keeping each magnet and metal cup assembly from separating during use or otherwise. The laminate may also be stitched or sewn through to hold the entire assembly in place in a garment or item of clothing. In a preferred embodiment, the laminate covering is thin, possibly less than 1 mm, and flexible, to facilitate the stitching of assembly into the fabric of a garment.

FIG. 3 is a side view of an assembly of a flat, round magnet 1 inserted inside a non-magnetic metal cup 2 both of which are enclosed entirely within a square, thin laminate covering 3. FIG. 3 shows that the pole of the flat, round magnet 1 that is exposed is the positive or pole. FIG. 3 also shows that the pole of the flat, round magnet 1 that is not exposed; i.e. covered by the closed side of the metal cup 2, is the negative or "−" pole. As such, the magnetic force of the "−" pole will be blocked or reduced.

Figure 4:
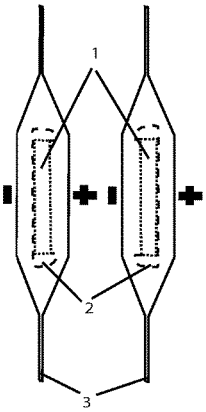
FIG. 4 is a side view of the invention consisting of two complete magnet assemblies of FIGS. 2 and 3 with the exposed side of the magnets in the assemblies facing each other such that the magnets will be attracted to one another.

FIG. 4 is a side view of two complete magnet assemblies facing one another, such that the exposed surface of each flat, round magnet 1 is facing the exposed surface of the opposing flat, round magnet 1. FIG. 4 also shows that the exposed pole of each flat, round magnet 1 are of opposing poles, such that each magnet assembly will be attracted to one another. When inserted into opposite sides of a garment opening, assemblies must be inserted such that the exposed surfaces have opposite polarity, such as in the FIG. 4, so that the assemblies will suffice to close the garment.

FIG. 5 is a top view of two complete magnet assemblies sewn or stitched into the fabric of a garment in a location where the garment would close if it were closed by other means, such as a button, snap, zipper, hook and eye or VELCRO®. FIG. 5 shows thread, yarn, or other material appropriate for stitching, 4 attaching the assembly to the fabric of the garment 5 by stitching the square laminate covering 3 to the fabric of the garment 5. The completed magnet assemblies pictured would sewn between the inside and outer fabric of the garment, such that the assemblies would be inside the fabric of the garment and hidden from view. Such assemblies may be stitched or sewn into a folded over piece of fabric at the edge of a garment, commonly referred to as a placket, or entirely within the garment fabric as appropriate for the garment. Assemblies of the opposing polarity would be stitched or sewn into plackets or the garment on the opposing sides of the relevant garment opening. The two opposing plackets or sides could then be closed using the opposing magnetic assemblies in much the same way snaps or buttons are lined up and closed on opposing sides of garment openings.

FIG. 6 is perspective view of a garment containing complete magnet assemblies sewn or stitched into the fabric of a garment in a location where the garment would close if it were closed by other means. Under the assemblies pictured would be opposing assemblies of the opposite pole of the assemblies pictured, such that each magnet assembly would be attracted to one another.

Operation—FIGS. 1-6

In operation one uses the invention similarly to closures in present use, such as snaps, VELCRO® or buttons. To close a conventional garment with snaps, one lines up male and female snaps on opposite sides of a garment opening and pushes them together until the garment is closed. The snaps can be pulled apart to open the garment. Male and female VELCRO® is also lined up and pushed together to close a garment and pulled apart to open a garment. Buttons are also used similarly, except a button is pushed through a button hole on the opposite side of the garment. On many garments snaps, VELCRO® or buttons are attached to plackets on opposite sides of a garment opening.

By sewing or stitching completed magnet assemblies of FIGS. 3 and 4 into the fabric of opposing sides of a garment of FIGS. 5 and 6 such that each exposed side of each flat, round magnet 1 is facing the exposed side of the opposing flat, round magnet 1 one can achieve the same affect. One only need to line up the opposing magnet assemblies and push them together, such that their exposed, flat surfaces will attract to one another and hold or attach to one another through the operation of magnetic force. The exposed sides of each flat, round magnet 1 of each assembly must be of opposing poles, so that each magnet assembly will be attracted to one another and close the garment. Surfaces with the same polarity would repel. Moreover, the magnetic assemblies will be stitched or sewn into plackets on the opposite sides of a garment opening or in between the layers of fabric of the garment if appropriate, but such enclosure in fabric will not reduce the effectiveness of the magnetic attraction.

ADDITIONAL EMBODIMENTS—NO FIGURE

While not pictured, the flat magnets used in the assemblies and the accompanying metal "cup" can be of various shapes, sizes and thicknesses. For example, the magnet and "cup" assemblies could be square, oval, rectangular or other shapes depending on what is appropriate for the garment in terms of shape. The magnet and "cup" may also vary in terms of size and thickness based on what is appropriate for the garment and also depending on the desired strength of magnetic attractions, as magnetic force of a permanent magnet varies with the size and thickness of the magnet.

The material of the metal cup may also vary depending on the desired mount of reduction in magnetic force of the magnet surface covered by the metal cup. Iron is a preferred embodiment, but other non-magnetic materials can be used.

Similarly, the laminate can vary in terms of size, shape and composition. Size and shape can vary as appropriate for the garment. Composition can vary as need to affect the flexibility or ease of sewing or stitching through the laminate.

Advantages

When the assemblies are closed nine effects increase the utility of the closure:

(1) The magnetic force of the assemblies is strong enough to keep a garment closed, but weak enough that it is easier to open and close the garment compared to presently used closures, such as buttons, snaps or zippers, to the advantage of users with reduced manual dexterity or in situations limiting the use of their hands.

(2) Since the magnets used in the assemblies have flat surfaces, there is no additional force or dexterity required to close the magnetic assemblies, such as is required by the male and female sides of snaps or buttons that are required to be pushed together or pushed through a hole in the garment fabric which is an additional advantage for users with low or reduced manual dexterity or in situations limiting the use of their hands.

(3) Since the magnets used in the assemblies have flat surfaces and do not require the additional force or dexterity required to close the male and female sides of snaps or required to push buttons through holes, the assemblies will save the users time in the dressing or undressing process.

(4) The laminate covering 3 functions to hold the flat, round magnet 1 and non-magnetic metal cup 2 together, so that they do not separate while in use.

(5) The laminate covering 3 also functions such that no glue or other adhesive that might come apart in the laundry or through use is necessary to hold the assembly together.

(6) The laminate covering 3 also functions such that the exposure to water or other liquids corrosive to metal will not damage or reduce the effectiveness of the assemblies during use or laundering of the garments in which they are used.

(7) The non-magnetic metal cup 2 functions to block the magnetic force on the side of the flat, round magnet 1 that it covers, such that that side of the flat, round magnet 1 will not attract opposing magnets decreasing bunching and keeping multiple pieces of clothing utilizing the magnetic fasteners from sticking together while in storage.

(8) Unlike other prior inventions, the complete magnet assemblies are sewn into garments individually and not as part of strip, ribbon or series, thereby increasing the applications of their use.

(9) Unlike other prior inventions, the magnet assemblies only need to oppose one another to attract and hold together and are not required to nest, interlock or otherwise be fitted together to properly close a garment to the advantage of persons with reduced manual dexterity or in situations limiting the use of their hands.

Conclusions, Ramifications and Scope

Accordingly, the reader will see that the flat magnet, metal cup and laminate assemblies will reduce the strength, effort and time required by a user to open or close a garment at the same time protecting the assemblies for corrosive elements or wear and tear. A garment can be opened easily and conveniently simply by harnessing the magnetic force of the assembly. No effort-increasing male or female or nesting or interlocking parts is required to effectively close or open opposing assemblies. Furthermore, the flat magnet, metal cup and laminate assemblies have additional advantages in that:

- they replace the need for more complicated fasteners presently in use, such as snaps, buttons, hooks and eyes, VELCRO® or zippers;
- the need for lesser manual dexterity to open or close the magnetic fasteners improves the utility of garments for users with reduced manual dexterity, such as reductions in manual dexterity caused by disease or age;
- the ease of use of the magnetic fasteners will save users time, particularly professional or non-professional caregivers required to change the clothes of their charges or dependants;
- the laminate obviates the need for adhesives or fusible materials that are likely to disintegrate or disassemble in use or in the laundry;
- the laminate will also increase the longevity of the magnet assemblies and the garments that use them, as they will not be exposed to water or other corrosive elements, such as with metal snaps or zippers or VELCRO®, which may deteriorate in the laundry;

the metal cup, which reduces magnetic force on the side of the assembly not used to close the garment, will keep garments with the magnetic closures from sticking together in storage or a variety of other circumstances increasing the overall utility of magnetic fasteners;

as the magnetic fasteners can be attached to garments individually, as opposed to in strips or other mechanisms, they can be used in all manner of garments and applications, including clothing for infants, children, adults, pets and accessories;

and the lack of nesting or other fitted parts increases the overall utility of magnetic fasteners.

Although the description above contains many specifics, these should not be construed as limiting the scope of the embodiments, but merely providing illustrations of some of the presently preferred embodiments. For example, the fasteners can have other shares, such as square, ovular or rectangular, as can the metal "cup" and the laminate covering.

Thus, the scope of the embodiments should be determined by the appended claims and their legal equivalents, rather than by the example given.

What is claimed is:

1. A garment assembly comprising:

a garment comprising fabric; and a first magnetic fastener, comprising:

a laminate covering comprising a first layer and a second layer, the first layer having a first uniform thickness and the second layer having a second uniform thickness, the two layers being directly attached to one another;

a metal cup; and a first magnet inserted into the metal cup, wherein the metal cup blocks or reduces magnetic force from the first magnet, the first magnet and the metal cup being enclosed within the laminate covering between the first and second layers, wherein the laminate covering covers the first magnet and the metal cup and protects both the first magnet and the metal cup from exposure to water or other corrosive elements, and wherein the first magnetic fastener is attached to the fabric of the garment.

2. The garment assembly according to claim 1, wherein the first magnet is inserted into the metal cup such that one flat surface of the first magnet is exposed and another flat surface of the first magnet is set against an inner surface of the metal cup.

3. The garment assembly according to claim 1, comprising a second magnetic fastener having a second magnet, the first and second magnetic fasteners being attached to the fabric on opposing sides of an opening in the garment so that an exposed surface of the first magnet has a polarity opposing a polarity of an exposed surface of the second magnet.

4. The garment assembly according to claim 3, wherein the first and second magnetic fasteners are utilized to close said opposing sides of the garment.

5. The garment assembly of claim 1, wherein the laminate covering is less than 1 mm in thickness.

6. The garment assembly of claim 1, wherein the first and second thicknesses are the same thickness.

7. The garment assembly of claim 1, wherein the laminate covering is stitched into the fabric of the garment such that stitches pass through the laminate covering.

8. The garment assembly of claim 7, wherein the stitches pass through the laminate covering where the first and second layers are attached.

9. The garment assembly of claim 1, wherein the laminate covering is attached into the fabric of the garment such that the fabric of the garment hides the laminate covering from view.

* * * * *